US006520747B2

(12) United States Patent
Gray et al.

(10) Patent No.: US 6,520,747 B2
(45) Date of Patent: Feb. 18, 2003

(54) SYSTEM FOR MEASURING CHANGE IN FLUID FLOW RATE WITHIN A LINE

(75) Inventors: Larry Gray, Merrimack, NH (US); Robert Bryant, Manchester, NH (US); Geoffrey Spencer, Manchester, NH (US); John B. Morrell, Manchester, NH (US)

(73) Assignee: Deka Products Limited Partnership, Manchester, NH (US)

( * ) Notice: Subject to any disclaimer, the term of this patent is extended or adjusted under 35 U.S.C. 154(b) by 0 days.

(21) Appl. No.: 10/067,661

(22) Filed: Feb. 4, 2002

(65) Prior Publication Data

US 2002/0088497 A1 Jul. 11, 2002

Related U.S. Application Data

(62) Division of application No. 09/574,050, filed on May 18, 2000, now Pat. No. 6,343,614, which is a continuation-in-part of application No. 09/408,387, filed on Sep. 29, 1999, now Pat. No. 6,065,941, which is a division of application No. 09/108,528, filed on Jul. 1, 1998, now Pat. No. 6,041,801.

(51) Int. Cl.[7] ..... G05D 7/00
(52) U.S. Cl. ..... 417/63
(58) Field of Search ..... 417/63

(56) References Cited

U.S. PATENT DOCUMENTS

| | | | | |
|---|---|---|---|---|
| 4,072,934 A | | 2/1978 | Hiller et al. | 340/243 |
| 4,431,425 A | | 2/1984 | Thompson et al. | 604/246 |
| 4,662,540 A | | 5/1987 | Schroter | 222/55 |
| 4,855,714 A | | 8/1989 | Clarkson et al. | 340/521 |
| 5,051,922 A | | 9/1991 | Toral et al. | 364/510 |
| 5,069,792 A | | 12/1991 | Prince et al. | 210/627 |
| 5,146,414 A | | 9/1992 | McKown et al. | 364/510 |
| 5,255,072 A | | 10/1993 | Mikasa et al. | 356/432 |
| 5,272,646 A | | 12/1993 | Farmer | 364/509 |
| 5,325,884 A | | 7/1994 | Mirel et al. | 137/110 |
| 5,355,890 A | | 10/1994 | Aguirre et al. | 128/680 |
| 5,428,527 A | | 6/1995 | Niemi | 364/152 |
| 5,463,228 A | | 10/1995 | Krause | 250/577 |
| 5,579,244 A | | 11/1996 | Brown | 364/558 |
| 6,065,941 A | * | 5/2000 | Gray et al. | 417/63 |

* cited by examiner

*Primary Examiner*—Gerald A. Michalsky
(74) *Attorney, Agent, or Firm*—Bromberg & Sunstein LLP

(57) ABSTRACT

A method and system for determining change in a fluid's flow rate within a line. The pressure variation in a second fluid, separated from the first by a pumping membrane, is measured in response to energy applied in a time-varying manner to the second fluid. From the response of the second fluid to the applied energy, changes in the flow rate of the first fluid are determined.

10 Claims, 3 Drawing Sheets

SYSTEM FOR MEASURING CHANGE IN FLUID FLOW RATE WITHIN A LINE

RELATED APPLICATIONS

The present application is a divisional of U.S. patent application Ser. No. 09/574,050, filed May 18, 2000, now U.S. Pat. No. 6,343,614, which is a continuation-in-part of U.S. patent application Ser. No. 09/408,387, filed Sep. 29, 1999, which issued as U.S. Pat. No. 6,065,941 on May 23, 2000, which is a divisional of application Ser. No. 09/108,528, filed Jul. 1, 1998, which issued as U.S. Pat. No. 6,041,801 on Mar. 28, 2000.

TECHNICAL FIELD

The present invention relates to fluid systems and, more specifically, to determining change in fluid flow rate within a line.

BACKGROUND ART

In fluid management systems, a problem is the inability to rapidly detect an occlusion in a fluid line. If a patient is attached to a fluid dispensing machine, the fluid line may become bent or flattened and therefore occluded. This poses a problem since the patient may require a prescribed amount of fluid over a given amount of time and an occlusion, if not rapidly detected, can cause the rate of transport to be less than the necessary rate. One solution in the art, for determining if a line has become occluded, is volumetric measurement of the transported fluid. In some dialysis machines, volumetric measurements occur at pre-designated times to check if the patient has received the requisite amount of fluid. In this system, both the fill and delivery strokes of a pump are timed. This measurement system provides far from instantaneous feedback. If the volumetric measurement is different from the expected volume over the first time period, the system may cycle and re-measure the volume of fluid sent. In that case, at least one additional period must transpire before a determination can be made as to whether the line was actually occluded. Only after at least two timing cycles can an alarm go off declaring a line to be occluded.

SUMMARY OF THE INVENTION

A method for determining change in fluid flow rate within a line is disclosed. In accordance with one embodiment, the method requires applying a time varying amount of energy to a second fluid separated from the first fluid by a membrane. Pressure of the second fluid is then measured to determine a change in the first fluid's flow rate, at least based on the pressure of the second fluid.

In another embodiment, the method consists of modulating a pressure of a second fluid separated from the first fluid by a membrane. The pressure of the second fluid is measured, and a value corresponding to the derivative of the pressure of the second fluid with respect to time is determined. The magnitude of the derivative value is then low pass filtered. The low pass output is compared to a threshold value for determining a change in the first fluid's flow rate. In yet another embodiment, the method adds the steps of taking the difference between the pressure of the second fluid and a target value and varying an inlet valve in response to the difference between the pressure of the second fluid and the target value for changing the pressure of the second fluid toward the target value.

In another embodiment, the target value comprises a time varying component having an amplitude and it is superimposed on a DC component. The amplitude of the time varying component is less than the DC component.

In an embodiment in accordance with the invention, a fluid management system dispenses an amount of a first fluid and monitors a state of flow of the first fluid. The system has a chamber, an energy imparter, a transducer and a processor. The chamber has an inlet and an outlet and a septum separating the first fluid and a second fluid. The energy imparter applies a time varying amount of energy on the second fluid. The transducer is used for measuring a pressure of the second fluid within the chamber and creating a signal of the pressure. The processor is used for determining a change in the first fluid's flow rate based on the signal.

In another embodiment, the fluid management system has the components of a chamber, a reservoir tank, a membrane, a transducer, and a processor. The reservoir tank contains a second fluid in fluid communication with the chamber and the tank has a valve disposed between the reservoir tank and the chamber. The membrane is disposed within the chamber between the first fluid and the second fluid and it is used for pumping the first fluid in response to a pressure differential between the first fluid and the second fluid. The transducer is used for measuring the pressure of the second fluid within the chamber and creating a pressure signal. The processor reads the pressure signal and takes the derivative of the pressure signal with respect to time. The processor then determines the magnitude of the derivative value and passes it through a low pass filter. The low pass output is then compared to a threshold value, for determining a change in the first fluid's flow rate. A change in the first fluid's flow rate causes an indicator signal. In another related embodiment, the processor controls the opening and closing of a valve in response to the difference between the pressure of the second fluid and a target value, the opening and closing of the valve adjusting the pressure of the second fluid toward the target value. In yet other embodiments, the first fluid may be dialysis fluid or blood and the second fluid may be air or a gas.

BRIEF DESCRIPTION OF THE DRAWINGS

The foregoing features of the invention will be more readily understood by reference to the following detailed description taken with the accompanying drawings.

DETAILED DESCRIPTION OF SPECIFIC EMBODIMENTS

Figure 1:
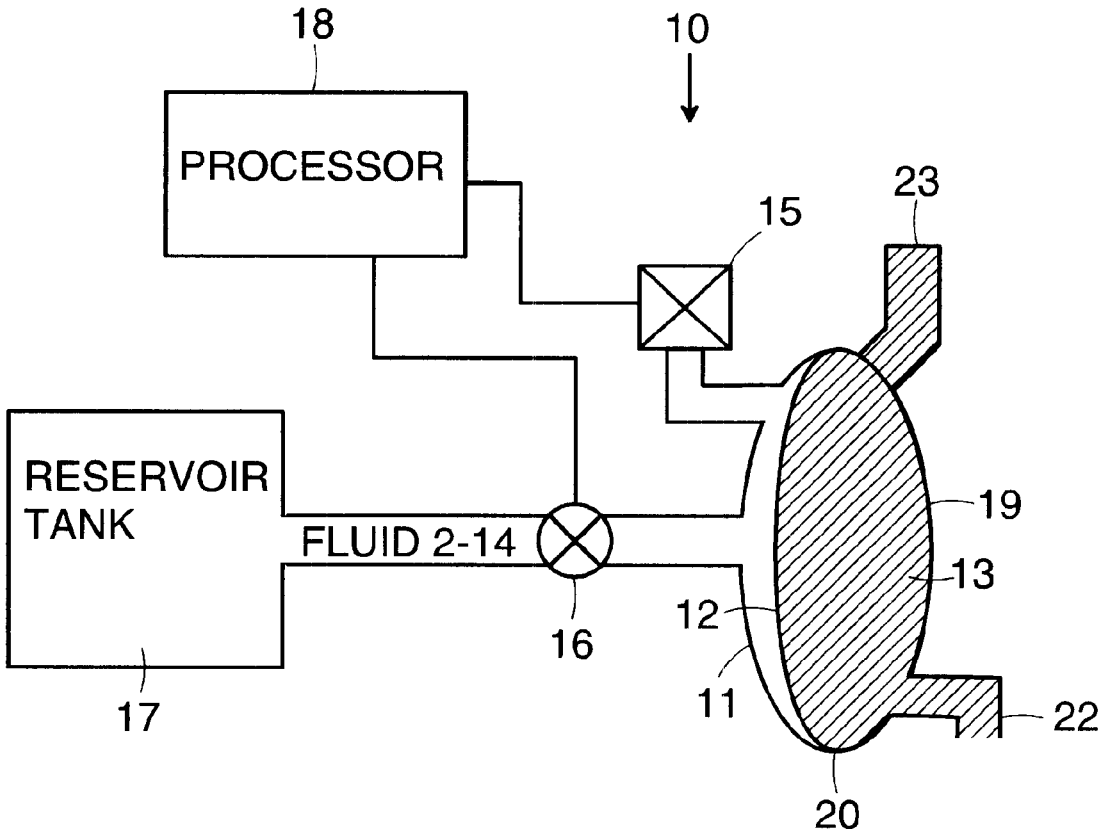
FIG. 1 is a schematic drawing of a simplified embodiment of the invention, showing a chamber, reservoir tank and processor.

Referring now to FIG. 1, a fluid management system is designated generally by numeral 10. The fluid management system is of the kind that uses the pressure of one fluid to move another fluid, such as one described in U.S. Pat. No. 5,628,908, which is assigned to the assignee of the present invention, and which is incorporated herein by reference. The invention will be described generally with reference to the fluid management system shown in FIG. 1, however it is to be understood that many fluid systems, such as dialysis machines and blood transport machines, may similarly benefit from various embodiments and improvements which are subjects of the present invention. In the following description and claims, the term "line" includes, but is not limited to, a vessel, chamber, holder, tank, conduit and, more specifically, pumping chambers for dialysis machines and blood transport machines. In the following description and claims the term "membrane" shall mean anything, such as a septum, which separates two fluids so that one fluid does not flow into the other fluid. Any instrument for converting a fluid pressure to an electrical, hydraulic, optical or digital signal will be referred to herein as a "transducer." In the following description and claims the term "energy imparter" shall refer to any device that might impart energy into a system. Some examples of energy imparters are pressurized fluid tanks, heating devices, pistons, actuators and compactors.

Overview of the System and Method of Determining Change in a Fluid's Flow Rate

The system and method provides a way for quickly determining change in fluid flow rate within a line. In a preferred embodiment the line is a chamber 11. The method determines a change in a fluid's flow rate, the fluid being referred to as a "first fluid." In one embodiment, the system and method are part of a fluid management system for transporting dialysis fluid 13 wherein the first fluid is moved through a chamber 11 by a pumping mechanism which may be a flexible membrane 12. The first fluid 13 may be blood, dialysis fluid, liquid medication, or any other fluid. The fluid which is on the opposite side of the membrane from the first fluid is known as the second fluid. The second fluid 14 is preferably a gas, but may be any fluid and in a preferred embodiment air is the second fluid.

The flexible membrane 12 moves up and down within chamber 11 in response to pressure changes of the second fluid. When membrane 12 reaches its lowest point it has come into contact with the bottom wall 19 of chamber 11. When membrane 12 contacts bottom wall 19 it is said to be at the bottom or end of its stroke. The end of stroke is an indication that first fluid 13 has stopped flowing. To determine if a change in the first fluid's flow rate has occurred, or whether the first fluid has stopped flowing, the pressure of the second fluid is continuously measured.

The pressure measurement is performed within the chamber or line by a transducer 15. Transducer 15 sends an output signal to a processor 18 which applies the remaining steps and controls the system. The signal is differentiated by processor 18, then the absolute value is taken, the signal is then low pass filtered, and finally the signal is compared to a threshold. By comparing the signal with the threshold, a change in the fluid's flow rate can be detected. The absolute value of the derivative may be referred to as the "absolute value derivative" and either the absolute value, the magnitude or a value indicating the absolute value may be used. Furthermore, if it is determined that first fluid 13 has stopped flowing, the system is capable of ascertaining whether an occlusion in an exit line 22 or entrance line 23 has occurred or whether the source of fluid is depleted. Because the algorithm detects rapidly when a change in flow rate has occurred, the delay for detecting whether exit line 22 or entrance line 23 is occluded may be reduced by an order of magnitude with respect to the prior art for such a system. A more detailed description of this method and its accompanying system will be found below. This system for determining a change in a fluid's flow rate may also be operated in unison with a control system.

In a preferred embodiment, the closed loop control system regulates the pressure within the container. It attempts to adjust the pressure of the second fluid to a target pressure by comparing the measured pressure signal of the second fluid to the target pressure and controlling the opening and closing of an inlet valve 16 to adjust the pressure of the second fluid. The term "attempts" is used in a controls-theoretical sense. The inlet valve 16 connects the chamber to a pressurized fluid reservoir tank 17.

Detailed Description of the System for Determining Change in a Fluid's Flow Rate Further referring to FIG. 1, in accordance with a preferred embodiment, fluid flows through line 11 in which pumping mechanism 12 is located. The mechanism may be of a flexible membrane 12 which divides the line 11 and is attached to the inside of the line's inner sides 20. Membrane 12 can move up or down in response to pressure changes within line 11 and is the method by which fluid is transported through line 11. The membrane 12 is forced toward or away from the line's wall by a computer controlled pneumatic valve 16 which delivers positive or negative pressure to various ports (not shown) on the chamber 11. The pneumatic valve 16 is connected to a pressurized reservoir tank 17. By "pressurized", it is meant that the reservoir tank contains a fluid 14 which is at a pressure greater than the fluid 13 being transported.

Pressure control in line 11 is accomplished by variable sized pneumatic valve 16 under closed loop control. Fluid 13 flows through the chamber in response to the pressure differential between first fluid 13 being transported and second fluid 14 which is let into the line from the reservoir tank. The reservoir tank 17 releases a time varying amount of second fluid 14 into the chamber. As the pressure of the fluid from the reservoir tank becomes greater, membrane 12 constricts the volume in which the transported fluid 13 is located, forcing transported fluid 13 to be moved. The flow of the fluid is regulated by processor 18 which compares the pressure of the second fluid to a target pressure signal and regulates the opening and closing of valve 16 accordingly.

If fluid flow stops, valve 16 will close after the pressure is at its target. This indicates either that the membrane or pumping mechanism 12 is at the end of its stroke or the fluid line is occluded. After the fluid flow ceases, the pressure within line 11 will remain at a constant value. Thus, when the pressure signal is differentiated, the differentiated value will be zero. With this information a system has been developed to determine changes in a fluid's flow rate.

Description of the Control System and the Feedback Loop

Figure 3:
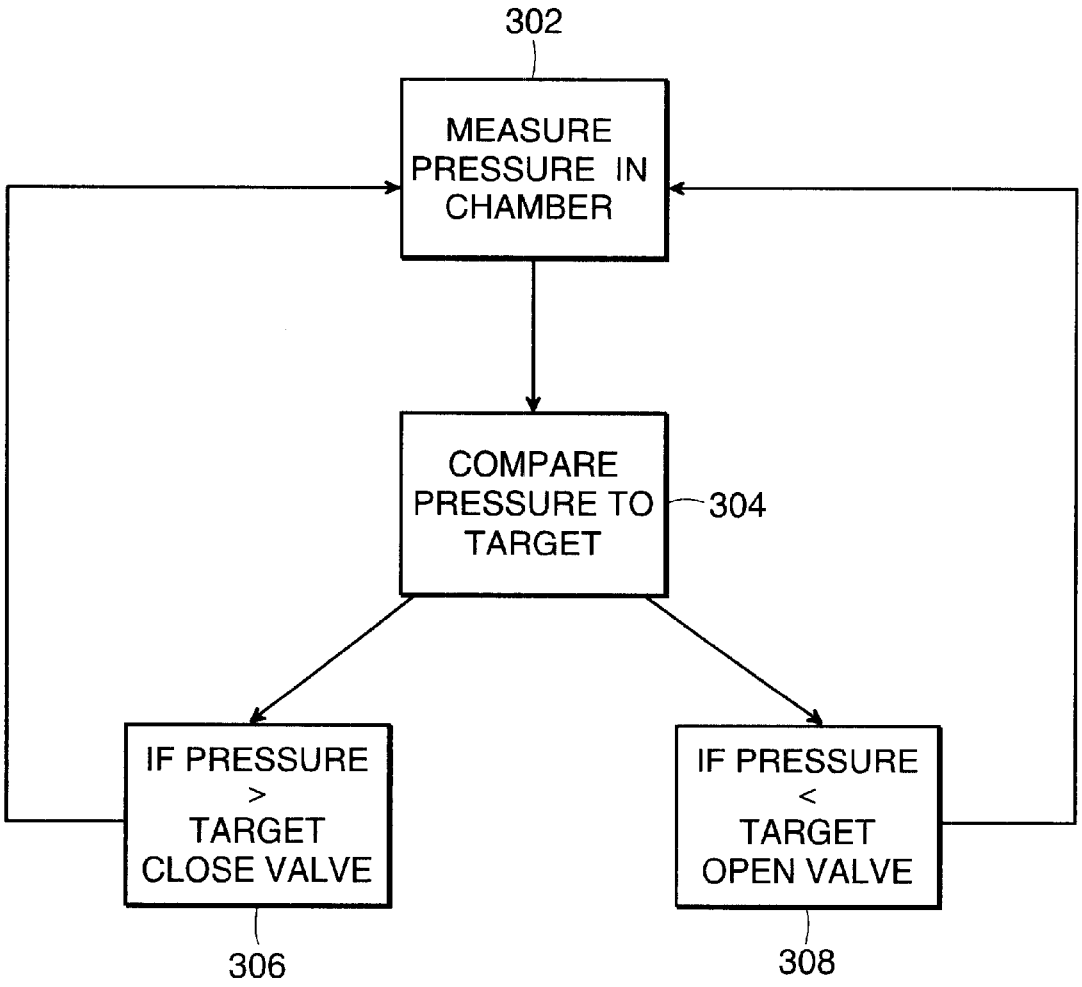
FIG. 3 shows a flow chart of a control feedback loop for setting the pressure within the chamber of FIG. 1, in accordance with an embodiment of the invention.

For the following section refer to the flow chart of FIG. 3 and to FIG. 1. The control system operates in the following manner in a preferred embodiment. The second fluid/air pressure is measured within the chamber through transducer 15 (step 302). The pressure signal that is produced is fed into processor 18 that compares the signal to the target pressure signal and then adjusts valve 16 that connects pressurized fluid reservoir tank 17 and chamber 11 so that the pressure of the second fluid/air in chamber 11 moves toward the target pressure (step 304). The target pressure in the closed loop system is a computer simulated DC target value with a small time varying component superimposed. In the preferred embodiment, the time varying component is an AC component and it is a very small fraction of the DC value. The time varying component provides a way to dither the pressure signal about the desired target value until the stroke is complete. Since the target pressure has the time varying signal superimposed, the difference or differential between the pressure signal and the target value will never remain at zero when fluid is flowing in the line. The target pressure will fluctuate from time period to time period which causes the difference between the pressure and the target pressure to be a value other than zero while fluid is flowing.

When a higher pressure is desired, indicating that the pressure in the chamber 11 is below the target pressure, valve 16 opens allowing the pressurizing fluid, which may be air 14 in a preferred embodiment, to flow from the reservoir tank to the chamber (step 306). The reservoir tank need not be filled with air. The reservoir tank 17 can be filled with any fluid, referred to as the second fluid 14, which is stored at a greater pressure than the first fluid 13, which is the fluid being transported. For convenience of the description the second fluid will be referred to as "air". As long as there is fluid flow of first fluid 13, valve 16 must remain open to allow air 14 to flow into chamber 11 so that constant pressure is maintained. When a lower pressure is targeted, which indicates that the pressure is greater than the target pressure, valve 16 does not open as much (step 308). When fluid stops moving valve 16 closes completely. Fluid is allowed to enter or exit chamber 11 depending on the change in pressure.

Figure 2B:
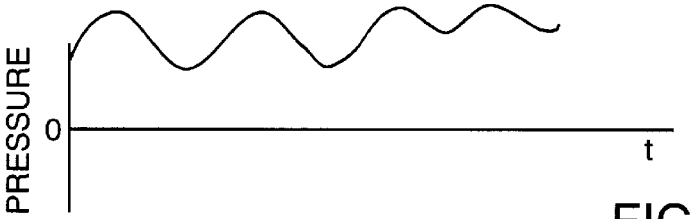
FIG. 2B shows a graphical representation of step 202 of FIG. 2A which is the pressure signal of the second fluid graphed with respect to time.
Figure 2C:
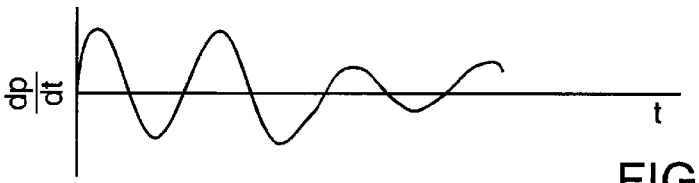
FIG. 2C shows a graphical representation of step 204 of FIG. 2A which is the derivative of step 202 graphed with respect to time.
Figure 2D:
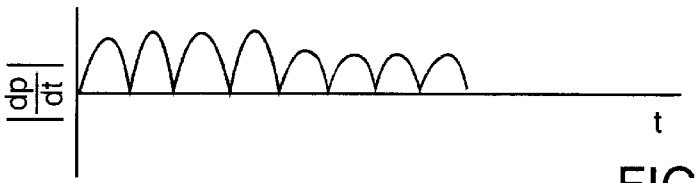
FIG. 2D shows a graphical representation of step 206 of FIG. 2A which is the magnitude of step 204 graphed with respect to time.
Figure 2E:
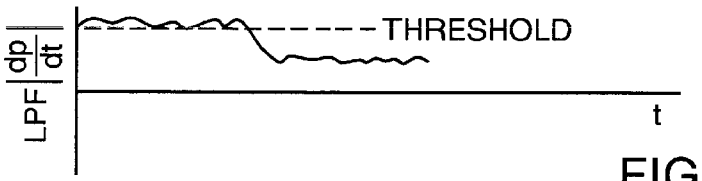
FIG. 2E shows a graphical representation of step 208 of FIG. 2A which is step 206 low pass filtered and graphed with respect to time.
Figure 2A:
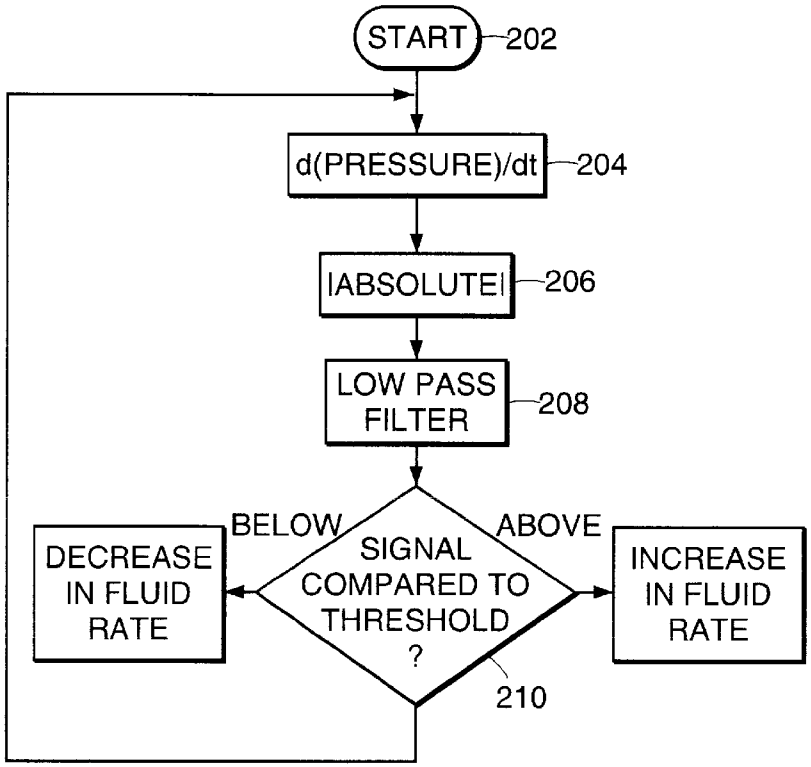
FIG. 2A shows a flow chart of a method for computing a change in the first fluid's flow rate, in accordance with an embodiment of the invention.

Detailed Description of the System and Method of Measuring Change in Fluid Flow Rate Referring to FIG. 2A the method for determining when a change in fluid flow rate has occurred is described in terms of the apparatus shown in FIG. 1. First in one embodiment, the pressure of the second fluid is measured within the chamber by the transducer which takes a pressure reading (step 202). FIG. 2B shows a graphical representation of step 202 of FIG. 2A which is the pressure signal of the second fluid graphed with respect to time, Each period, the pressure of the second fluid changes so long as membrane 12 is not at the end of its stroke due to the AC component that is superimposed upon the DC target pressure. The AC component causes valve 16 to open and close from period to period, so that the pressure of the second fluid 11 mimics the AC component of the target pressure and is modulated. The pressure change between periods will not be equal to zero, so long as fluid continues to flow. Additionally, an increase in fluid flow rate will cause an increase in the pressure change between periods. A decrease in fluid flow rate will cause a decrease in the pressure change between periods.

The measured pressure is sent to processor 18 which stores the information and differentiates the measured pressure signal with respect to the set time interval (step 204). FIG. 2C shows a graphical representation of step 204 of FIG. 2A which is the derivative of step 202 graphed with respect to time.

Because the AC component of the target pressure causes inlet valve 16 to adjust the actual pressure of the air/second fluid 14 within chamber 11 during the stroke, the pressure differential will change between each time interval in a likewise manner. When pumping mechanism/membrane 12 reaches the end of stroke, the pressure differential (dp) per time interval will approach zero, when the fluid stops flowing. When fluid flow rate increases, the differential (dp) per time interval will increase. When fluid flow rate decreases, the differential (dp) per time interval will decrease.

Processor 18 then takes the absolute value of the differentiated pressure signal (step 206). FIG. 2D shows a graphical representation of step 206 of FIG. 2A which is the magnitude of step 204 graphed with respect to time.

The absolute value is applied to avoid the signal from crossing through zero. During periods of fluid flow, the superimposed time varying signal on the target pressure may cause the target value be larger during one period than the actual pressure and then smaller than the actual pressure in the next period. These changes will cause the valve to open and close so that the actual pressure mimics the time varying component of the target pressure. From one period to the next the differential of the actual pressure signal, when it is displayed on a graph with respect to time may cross through zero. Since a zero pressure reading indicates that fluid has stopped flowing, a zero crossing would indicate that fluid has stopped flowing even when it had not. When the absolute value is applied the magnitude of the signal results and this limits the signal results to positive values.

The pressure signal is then low pass filtered to smooth the curve and to remove any high frequency noise (step 208). The filter prevents the signal from approaching zero until the end of stroke occurs. FIG. 2E shows a graphical representation of step 208 of FIG. 2A which is step 206 low pass filtered and graphed with respect to time.

If the filtered signal falls below a predetermined threshold the fluid has stopped flowing and either the membrane has reached the end of its stroke or the fluid line is occluded (step 210). The threshold value is used as a cutoff point for very small flow rates. Low flow rates are akin to an occluded line. The threshold is set at a value that is above zero and at such a level that if the signal is above the threshold, false indications that the fluid has stopped will not occur. The threshold is determined through various measurement tests of the system and is system dependent.

A threshold value may be set to the target value wherein if the filtered signal is above the threshold the rate is increasing and if it is below the threshold it is decreasing. Similarly, threshold values may be set at other values that indicate high or low fluid flow rates. A filtered signal falling above or below a predetermined threshold indicates a higher or lower fluid flow rate, respectively (step 210), hence changes in fluid flow rate can be detected. Thresholds are determined through various measurement tests of the system and are system dependent.

Indicating if a Fluid Line is Occluded

In a preferred embodiment, when the end of stroke is indicated by processor 18, the system may then determine if one of fluid lines 22,23 is occluded. This can be accomplished through a volumetric fluid measurement. The air volume is measured within line 11. The ideal gas law can be applied to measure the fluid displaced by the system. Since pressure change is inversely proportional to the change in volume within a fixed space, air volume in pumping chamber 11 can be measured using the following equation.

$$Va=Vb(Pbi-Pbf)/(Paf-Pai)$$

Where

Va=pump chamber air volume

Vb=reference air volume (which is known)

Pbi=initial pressure in reference volume

Pbf=final pressure in reference volume

Paf=final pressure in pump chamber

Pai=initial pressure in pump chamber

Once the volume of air is calculated the value of the air volume at the beginning of the stroke is then recalled. The differential between the previous and current volume measurements equates to the volume of fluid 13 that is displaced. If the amount of fluid 13 that is displaced is less than half of what is expected, entrance or exit line 22,23 is considered occluded and an alarm can be sent either visually or through sound or both. The entire process may be performed in less than five seconds as opposed to the prior art which may take upwards of thirty seconds to determine if a fluid line is occluded. The algorithm is very robust over a wide range of fill and delivery pressures and is intolerant to variations in the valve used to control pressure.

It is possible to use the ideal gas law to create a system to measure a no flow condition based on parameters beside pressure. If energy is allowed to enter the system through the second fluid in a time varying manner the change in volume, or temperature may be measured with respect to the second fluid. If the change approaches zero for the volume or temperature the first fluid will have stopped flowing.

Alternative embodiments of the invention may be implemented as a computer program product for use with a computer system. Such implementation may include a series of computer instructions fixed either on a tangible medium, such as a computer readable media (e.g., a diskette, CD-ROM, ROM, or fixed disk), or transmittable to a computer system via a modem or other interface device, such as a communications adapter connected to a network over a medium. The medium may be either a tangible medium (e.g., optical or analog communications lines) or a medium implemented with wireless techniques (e.g., microwave, infrared or other transmission techniques). The series of computer instructions embodies all or part of the functionality previously described herein with respect to the system. Those skilled in the art should appreciate that such computer instructions can be written in a number of programming languages for use with many computer architectures or operating systems. Furthermore, such instructions may be stored in any memory device, such as semiconductor, magnetic, optical or other memory devices, and may be transmitted using any communications technology, such as optical, infrared, microwave, or other transmission technologies. It is expected that such a computer program product may be distributed as a removable media with accompanying printed or electronic documentation (e.g., shrink wrapped software), preloaded with a computer system (e.g., on system ROM or fixed disk), or distributed from a server or electronic bulletin board over the network (e.g., the Internet or World Wide Web).

Although various exemplary embodiments of the invention have been disclosed, it should be apparent to those skilled in the art that various changes and modifications can be made which will achieve some of the advantages of the invention without departing from the true scope of the invention. These and other obvious modifications are intended to be covered by the appended claims.

What is claimed is:

1. A fluid management system for dispensing an amount of a first fluid and monitoring a state of flow of the first fluid, the system comprising:

a chamber having an inlet and an outlet and a septum separating the first fluid and a second fluid;

an energy imparter for applying a time varying amount of energy on the second fluid;

a transducer for measuring a pressure of the second fluid within the chamber and creating a signal of the pressure; and a processor for determining change in the first fluid's flow rate based on the signal.

2. The system according to claim 1, wherein the second fluid is a gas.

3. The system according to claim 1, wherein the second fluid is air.

4. The system according to claim 1, wherein the first fluid is dialysis fluid.

5. The system according to claim 1, wherein the first fluid is blood.

6. A fluid management system for dispensing an amount of a first fluid and monitoring a state of flow of the first fluid, the system comprising:

a chamber having an inlet and an outlet;

a reservoir tank containing a second fluid in fluid communication with the chamber, valve disposed between the reservoir tank and the chamber;

a membrane disposed within the chamber between the first fluid and the second fluid for pumping the first fluid in response to a pressure differential between the first fluid and the second fluid;

a transducer for measuring a pressure of the second fluid within the chamber and creating a signal of the pressure; and a processor for determining a change in the first fluid's flow rate based at least on the signal.

7. A system according to claim 6, wherein the processor further controls opening and closing of the valve.

8. A system according to claim 6, further including activating an indicator signal based on the change of the first fluid's flow rate.

9. A fluid management system for dispensing an amount of a first fluid and monitoring a state of flow of the first fluid, the system comprising:

a chamber having an inlet and an outlet;

a reservoir tank containing a second fluid in fluid communication with the chamber, the tank having a valve disposed between the reservoir tank and the chamber;

a membrane disposed within the chamber between the first fluid and the second fluid for pumping the first fluid in response to a pressure differential between the first fluid and the second fluid;

a transducer for measuring the pressure of the second fluid within the chamber and creating a pressure signal; and a processor for i) receiving the pressure signal;

ii) determining a value corresponding to the derivative with respect to a timing period of the pressure signal creating a derivative value;

iii) determining a value corresponding to the magnitude of the derivative value creating an magnitude derivative;

iv) low pass filtering the magnitude derivative creating a low pass output;

v) comparing the low pass output to a threshold value for determining a change in the first fluid's flow rate and vi) causing an indicator signal based on the change in the first fluid's flow rate.

10. The system according to claim 9, wherein the processor controls the opening and closing of a valve in response to the difference between the pressure of the second fluid and a target value, the opening and closing of the valve adjusting the pressure of the second fluid toward the target value.

* * * * *